US005233748A

United States Patent [19]

Logan et al.

[11] Patent Number: 5,233,748

[45] Date of Patent: Aug. 10, 1993

[54] ADJUSTABLE OVAL MAT CUTTER

[76] Inventors: Curtis Logan, 23845 High Ridge Dr., Lake Zurich, Ill. 60047; Malcolm Logan, 555 Signal Hill Rd., North Barrington, Ill. 60010

[21] Appl. No.: 647,847

[22] Filed: Jan. 30, 1991

[51] Int. Cl.[5] ..... B26B 29/00

[52] U.S. Cl. ..... 30/310; 30/293; 33/27.032; 33/30.6

[58] Field of Search ..... 30/310, 286, 289, 293, 30/294, 300, 164.95, DIG. 5; 33/27.01, 27.031, 30.1, 30.6, 27.032, 27.033; 83/565, 879, 881

[56] References Cited

U.S. PATENT DOCUMENTS

| | | | |
|---|---|---|---|
| 660,211 | 10/1900 | Durkel | 30/310 |
| 705,576 | 7/1902 | Forker | 83/565 |
| 1,326,260 | 12/1919 | Hardebeck | 30/294 |
| 1,614,772 | 1/1927 | Bambini et al. | 30/293 |
| 1,806,484 | 5/1931 | Michaud | 30/293 |
| 2,215,216 | 9/1940 | Gits et al. | 30/293 |
| 2,512,786 | 6/1950 | Borg | 33/27.01 |
| 2,872,732 | 2/1959 | Arrowood | 30/DIG. 5 |
| 2,908,972 | 10/1959 | Nitenson | 30/293 |
| 3,236,129 | 2/1966 | Bishop | 83/879 |
| 3,820,245 | 6/1974 | Yozzo | 33/27.01 |
| 4,148,142 | 4/1979 | Sullivan et al. | 30/293 |
| 4,233,736 | 11/1980 | Duggins et al. | 30/293 |
| 4,649,647 | 3/1987 | Kaulfuss | 30/293 |
| 4,858,322 | 8/1989 | Kluga | 30/310 |
| 4,934,054 | 6/1990 | Morozumi | 30/293 |

*Primary Examiner*—Frank T. Yost
*Assistant Examiner*—Hwei-Siu Payer
*Attorney, Agent, or Firm*—Eugene F. Friedman

[57] ABSTRACT

An oval mat cutter allows the continuous adjustment of the overall size of the oval as well as the difference between its larger and smaller axes. The cutter may also produce circles. The cutter separates the knife from a first point which it keeps in a first groove. It separates this first point from a second point which it keeps in a second groove lying perpendicular to the first. A generally circular motion of the cutter while maintaining the two points in their respective grooves creates the desired oval. Making the two points in their respective groove coincide with each other will result in the production of a circle. The knife that makes the actual cut sits next to a wheel whose outer circumference has a sharp ridge. The knife has configurations where it extends to various distances beyond the edge of the wheel and one in which it sits within the wheel's circumference. To make a clean cut, the wheel, with the knife retracted, makes a groove in the mat. Extending the wheel one notch each time the cutter travels around the oval allows for the development, in stages, of a clean cut in the mat.

19 Claims, 6 Drawing Sheets

FIG. 12
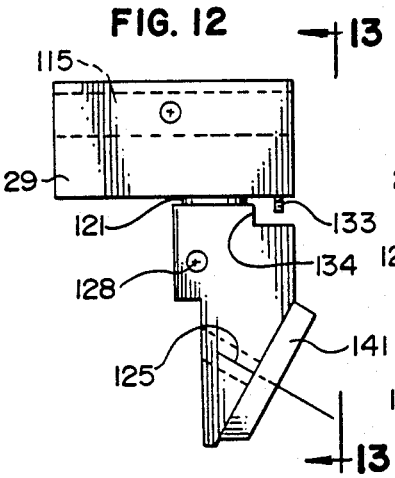
FIG. 13
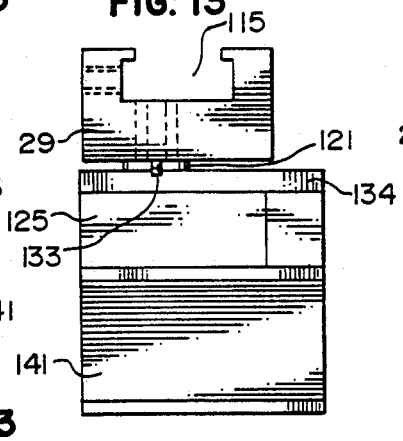
FIG. 14
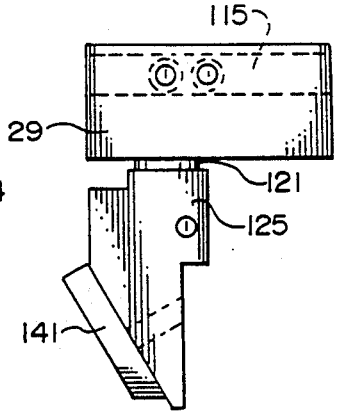
FIG. 15
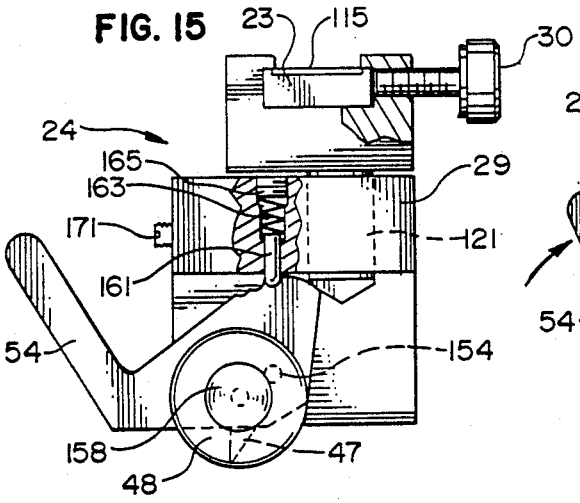
FIG. 16
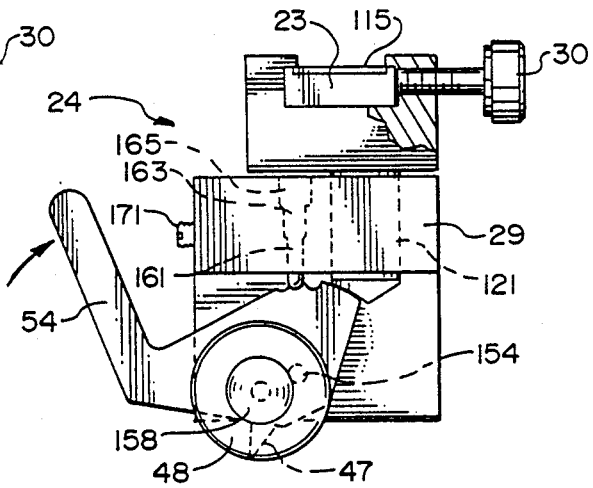
FIG. 17
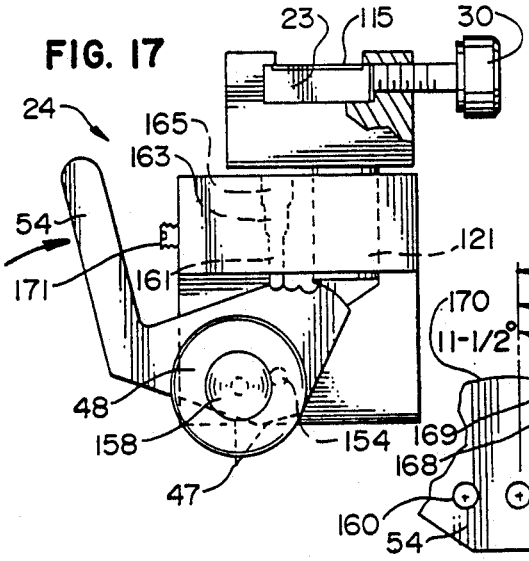
FIG. 18
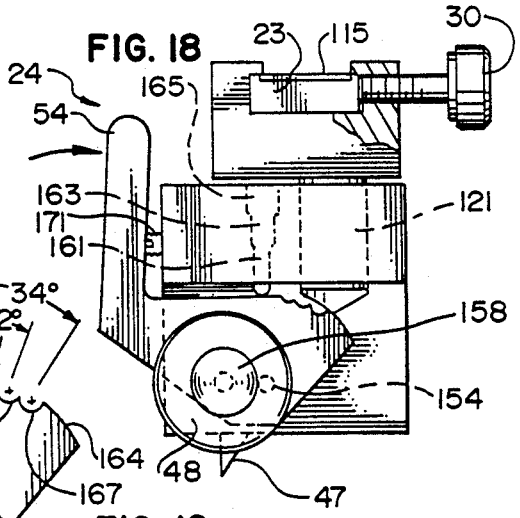
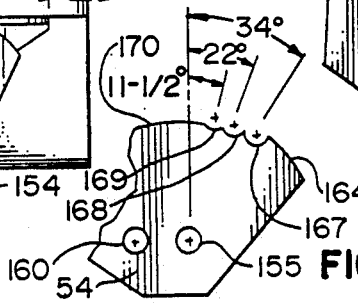
FIG. 19

ADJUSTABLE OVAL MAT CUTTER

BACKGROUND

An attractive manner of showing off a picture or a photograph involves placing an oval mat about the view of interest. Furthermore, the oval, when cut into the mat, should have a clean cut with a beveled edge. Moreover, the oval should have the particular overall size as well as the relative lengths of its longer and shorter axes to most propitiously set off the view inside. Oval cutters now in use do not achieve these objectives. One type of cutter employs a complicated system of bars and rods placed over a mat in order to cut the desired oval. However, this complicated mechanism may show signs of wear, become imprecise, and requires a significant economic outlay. Furthermore, the size of the mat that it may work on, of course, is limited by the overall dimensions of the superstructure supporting the cutter itself.

A variant of this type of cutter employs an overhead superstructure that actually utilizes a turntable for mounting the mat. Again, this type of structure limits the size of the mat that can undergo cutting, involves a substantial economic outlay, and may not always prove accurate after extended use.

U.S. Pat. No. 4,233,736 to R. W. Duggins et al. shows a cutter which employs a string or cable placed around two positioning pins on the surface of the mat. This type of system requires substantial manual dexterity to maintain the cable taut around the pins. It also demands substantial effort to properly position the pins and determine the length of the cable to obtain an oval with the overall desired size as well as the requisite differences between its larger and smaller axes.

A further type of cutter employs one of several different cams suspended over the mat to achieve the desired oval. This system suffers from the lack of complete adjustability of the ovals' dimensions. As with other superstructures, it also limits the size of the actual mat that it can operate upon.

Another cutter places two pins, separated from each other, on axes that cross each other perpendicularly. While avoiding many of the problems associated with the above cutters, it shows a serious lack of continuous adjustability of the ovals' various dimensions. As a consequence, the search for an inexpensive, adaptable, and fully adjustable oval cutter continues.

A further problem encountered with oval and circular mat cutters concerns the initial incision of the cutting knife into the mat itself. The knife of course displays some degree of flexibility. The mechanism holding the knife does not have total rigidity. As a result, where the knife first cuts through the mat, it displays a tendency to avoid the exact line of the desired oval by a small amount. This has often caused the users of such equipment to employ a file to remove the rough spot created by the inaccurate initial incision of the mat. As a consequence, the desire remains for a cutter that will not leave rough spots at the initial insertion of the knife into the mat.

SUMMARY

Typically, an oval mat cutter includes an incising device which makes a cut into a mat at a first particular location. It also has some sort of guiding device which controls the motion of the incisor about a second particular location. An improved mat cutter results where the guiding device includes a first extension means, coupled to the incising device, for rigidly separating the incising device from a first point removed from the incising device itself. A first restricting means, coupled to the first extension means, limits the locus of the first point mentioned above to a first line passing through the second particular location.

A second extension means couples to the incising device and to the first point. It rigidly separates both the incising device and the first point from a second point removed from the incising device itself. An adjusting device couples to the second extension means as well as the first and second points. It adjusts the distance between the first and second points continuously over a predetermined range. In other words, it allows infinitely small adjustments over this range of distances. This in effect allows the operator to select exactly the difference between the larger and smaller dimensions of the oval.

Lastly, a second restraining means coupled to the second extension means. It limits the locus of the second point to a second line passing through the second particular location at a nonzero angle to the first line.

An incising device which actually cuts a line in a mat typically includes a knife for making the actual incision in the material. It furthermore has some sort of restricting device, coupled to the knife, for limiting the movement of the knife to the immediate vicinity of the line which is should cut.

To improve the operation of this cutting device. it will also include a depth controller, coupled to the knife and having a plurality of configurations. It serves to limit the depth of the knife below the surface of the mat undergoing cutting. This controller, in at least two of its configurations, limits the knife to different depths below the mat's surface.

Furthermore, the improved cutting device should also include a selector, coupled to the controller, for manually changing the controller between its various configurations. In this way, the knife, rather than attempting to cut through the entire mat at once, will make a small scoring on the mat followed by deeper and deeper cuts. This eliminates the pressure on the knife to cut all of the way through which has the propensity to, when first entering into the mat, create a slight deflection of the knife from the desired line.

To limit the depth to which the knife enters the mat, the controller may incorporate a wheel which moves along upon the surface of the mat. In its different configurations, the controller extends the knife edge to different distances beyond the exterior circumference of this wheel and thus, different depths into the mat. Ideally, the exterior circumference of the wheel itself may include one or more sharp ridges. When the knife remains within the exterior circumference of the wheel, tracing the wheel around the mat will cause it to make a groove into the mat's surface. This groove will then help direct the knife into the mat's surface to limit or even avoid any deviation of the knife from its desired line when making its first slight cut into the mat.

BRIEF DESCRIPTION OF THE FIGURES

FIG. 7A shows the bottom side of the sliding block seen in FIG. 7.

FIG. 12 gives a front elevational view of the channel block and swivel foot used to hold the roller wheel and knife of the cutter.

FIG. 13 provides a side elevational view along the line 13—13 of the channel block and swivel foot of FIG. 12.

FIG. 14 gives a rear elevational view along the line 14—14 of the channel block and swivel foot of FIG. 13.

FIG. 15 provides a side elevational view, as seen from the left side of FIG. 12, of the channel block and swivel foot but also including the cammed stepping lever, roller wheel, and knife (in phantom) with the knife withdrawn to within the outer circumference of the roller wheel.

FIG. 16 gives the same view of the channel block and swivel foot of FIG. 15 but with the stepping lever having moved to the configuration in which the knife extends slightly beyond the outer circumference of the roller wheel.

FIG. 17 provides the same view of FIGS. 15 and 16 but where the stepping lever has moved to the further position which extends the knife further beyond the circumference of the roller wheel.

FIG. 18 provides a similar view to that of FIGS. 15 to 17 but in which the knife extends the furthest beyond the outer circumference of the roller wheel to make a complete cut through the mat.

FIG. 19 provides an exploded view of the cam surface of the stepping lever of FIGS. 15 to 18.

DETAILED DESCRIPTION

Figure 1:
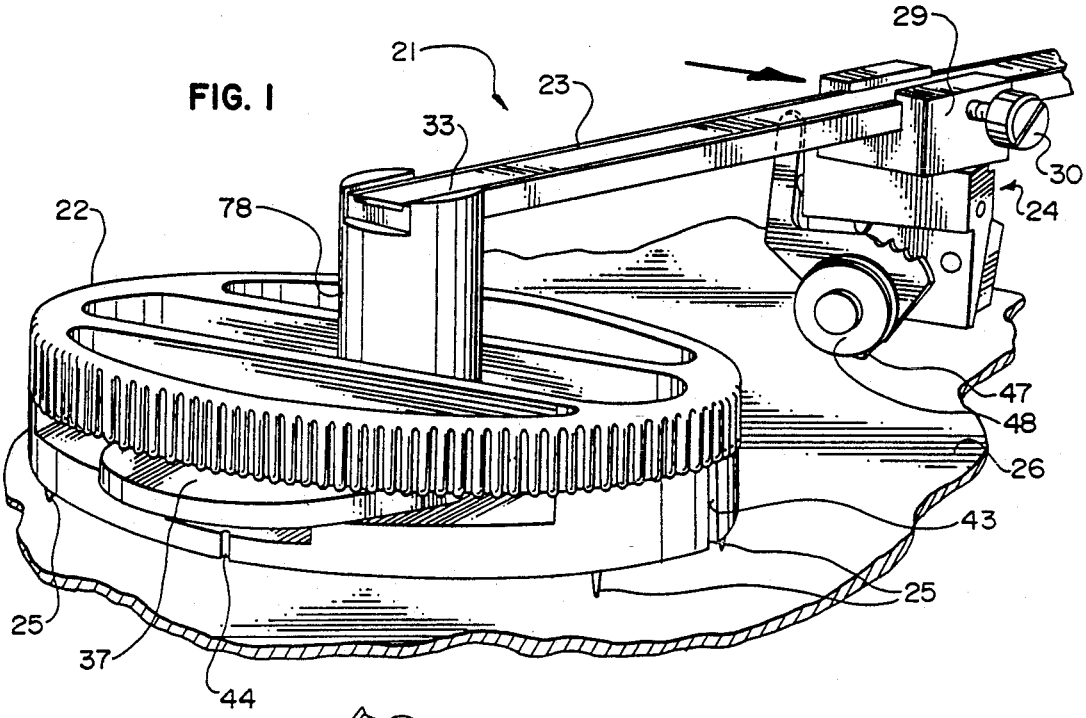
FIG. 1 gives an isometric view of an adjustable oval mat cutter cutting a line into a piece of mat.

FIG. 1 shows the oval cutter generally at 21 having the base section 22, the scale arm 23, and the cutter mechanism generally at 24. The pins 25 anchor the cutter base 22 to the mat 26 to keep it from slipping during the actual cutting operation.

Two dimensions determine the final appearance of the oval. These include, first, the overall size and, second, the difference between the larger and smaller axes of the oval. The adjustment of the overall size is pictured in FIG. 2 where the channel block 29 moves along the scale arm 23 to control the oval's overall size. The tightening nut 30 keeps the channel block 29 in a selected location. The arrow 31 points to the appropriate marker 32 on the scale 33 to indicate the overall dimension of the resulting oval.

Figure 8:
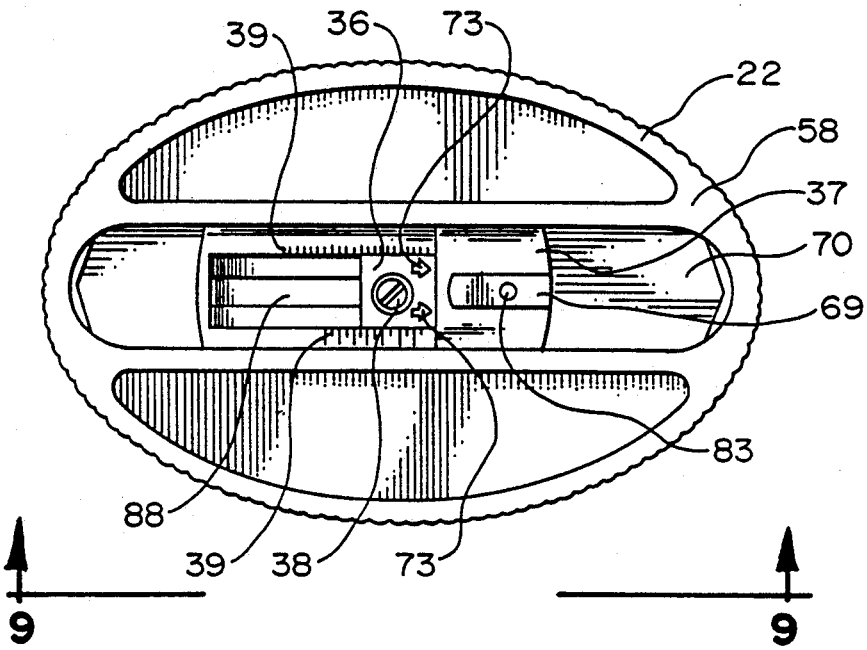
FIG. 8 gives a top plan view of the base of the mat cutter of the prior figures.

As discussed in more detail with regards to FIG. 8 below, the second adjustment determines the ellipticity, or the noncircularity, of the resulting oval. This receives adjustment through the adjustment plate 36 which sits on the radial plate 37. The bolt 38 maintains the adjustment made according to the scales 39 on the radial plate 37. The adjustment made through the adjusting plate 36 determines the difference between the longer and shorter axes of the oval. With the two adjustments made as illustrated in FIGS. 2 and 3, the oval cutter 21 may then actually proceed to cut the appropriate figure into the mat.

Figure 2:
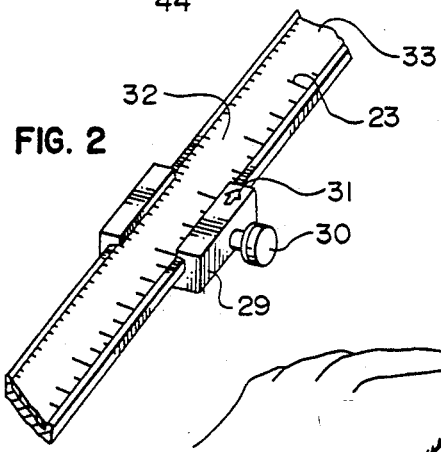
FIG. 2 shows the components for adjusting the overall size of the oval produced by the cutter of FIG. 1.
Figure 3:
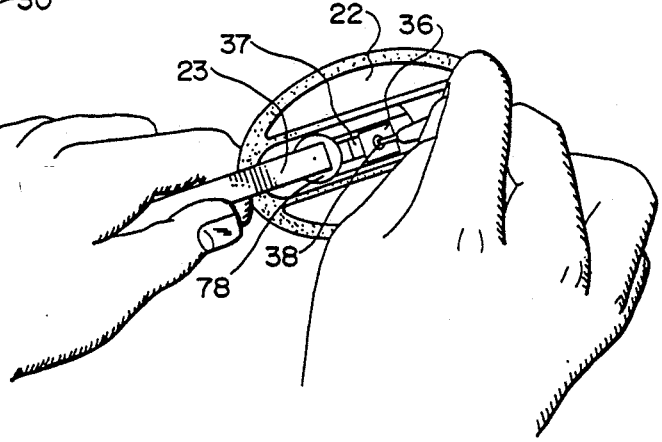
FIG. 3 shows the components for adjusting the difference between the larger and smaller axes of the oval produced by the cutter of FIG. 1.
Figure 4:
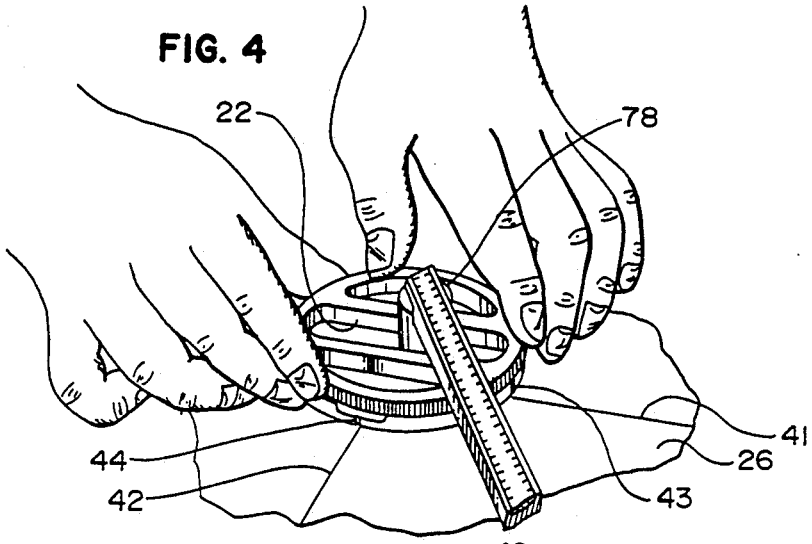
FIG. 4 illustrates the placement of the cutter of FIG. 1 on a mat to achieve the proper alignment of the larger and smaller dimensions of the resulting oval.
Figure 5:
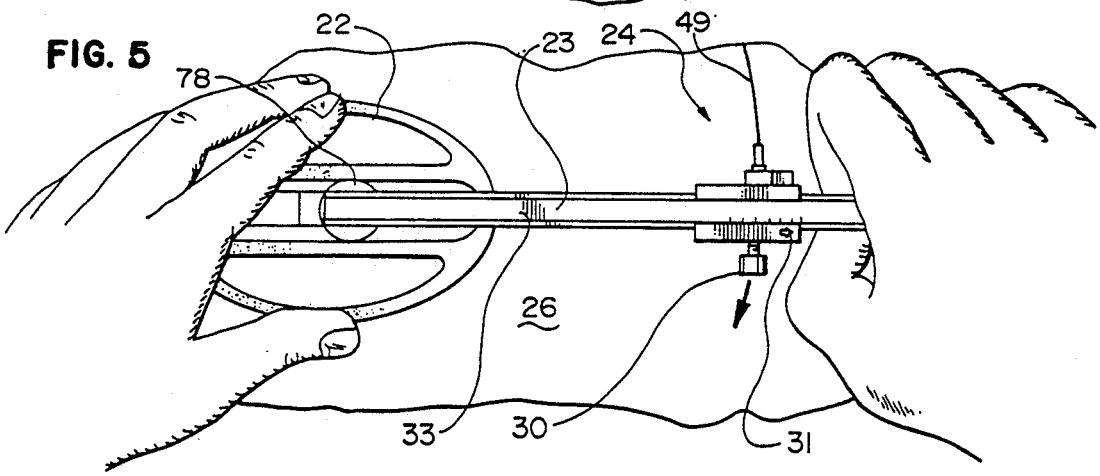
FIG. 5 portrays the mat cutter of the prior figures in operation.

The use of the cutter 21, after setting the size and configuration of the oval in FIGS. 2 and 3, appears in FIG. 4. It begins with drawing the line 41 on the mat 26 for the longer axis and the line 42 which would correspond to the oval's shorter axis. As indicated in FIG. 4, the operator then places the base 22 on the mat. He aligns the markers 43 on the narrow ends of the base 22 with the drawn line 41 on the mat and similarly the markers 44 on the broad sides of the base 22 with the line 42 representing the shorter axis of the oval. Placing the markers 43 and 44 on the lines 41 and 42, respectively, assures the correct orientation of the resulting oval on the mat 26.

Figure 6:
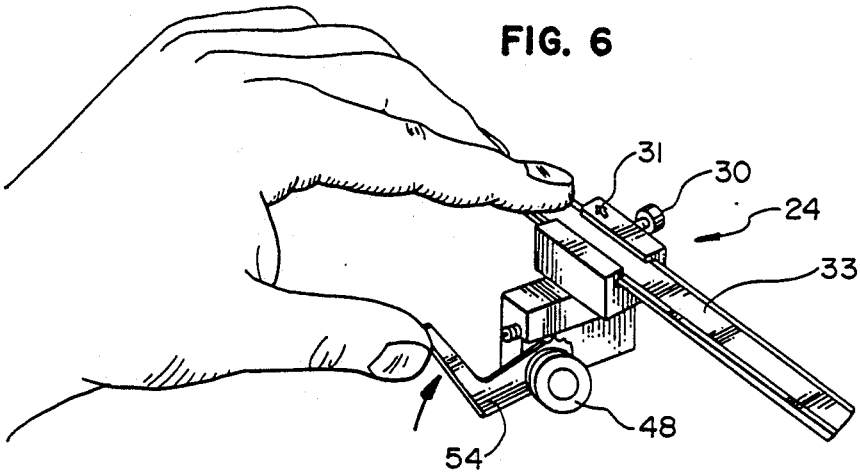
FIG. 6 displays the adjustment of the extension of the knife of the prior figures beyond the wheel to achieve a deeper cut into the mat.
Figure 7:
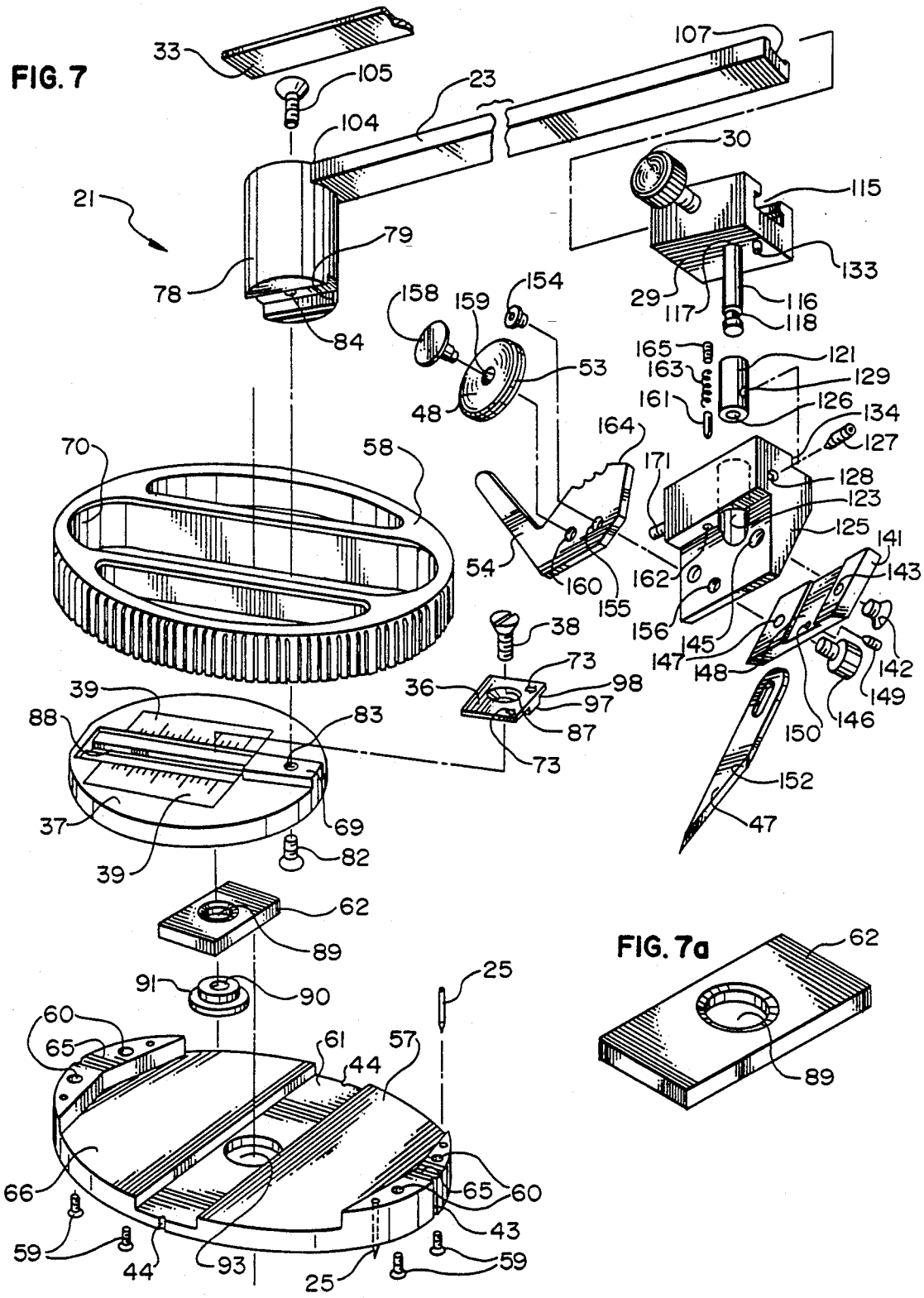
FIG. 7 provides an exploded view of the mat cutter of the prior figures.

As discussed in detail below with regards to FIGS. 15 to 18, the cutter 24 displays a multitude of configurations which place the cutting knife 47 at different locations relative to the exterior circumference of the roller wheel 48. To commence the creation of the desired oval, the operator places the cutter 24 in the configuration shown in FIG. 15 in which the knife 47 remains retracted within the outer circumference of the wheel 48. He then traces the line or groove 49 with the wheel 48 on the mat 26. Preferably, as shown in FIG. 7, the wheel 48 includes the sharp ridges 53 on its outer edge. The sharp ridges help make the groove 49 into the mat 26. Making the groove 49 prior to the actual incision into the mat 26 orients the actual cutting by the knife 47 and assists in precluding the irregularity previously encountered by the initial entry of the knife into the mat. After the operator has made the groove 49 into the mat 26 with the wheel 48, he then, as shown in FIG. 6, moves the wheel 48 slightly upward relative to the knife or, equivalently, moves the knife somewhat downward relative to the outer edge of the wheel 48 to achieve the configuration shown in FIG. 16. He does this by pushing upward on the stepping lever 54 and moving it in the clockwise direction as indicated in FIG. 6. The operator then moves the cutter 24 a second time around the oval on the mat 26 to achieve a very shallow cut into the mat 26. The shallowness of this cut aided by the groove 49 already on the mat 26 again helps avoid the initial irregularity of when a knife first cuts into the mat 26. After completing the first cut of the knife 47 into the mat 26 around the entire desired oval, the operator twice repeats the process by again pushing upwardly on the stepping lever 54 to expose more of the knife and going around the oval with the knife making a deeper cut. The fourth and final tour around the oval with the knife at its maximum depth should result in the knife cutting completely through the mat. Having done so in stages, however, after the formation of the groove 49 by the roller wheel 48 should minimize or even eliminate the initial irregularity previously seen when a knife enters a mat that it is cutting.

Figure 9:
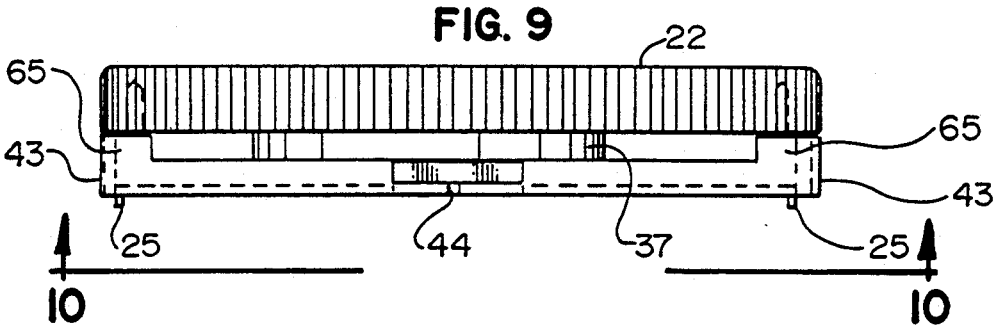
FIG. 9 gives a side elevational view along the line 9—9 the base of the mat cutter of FIG. 8.
Figure 10:
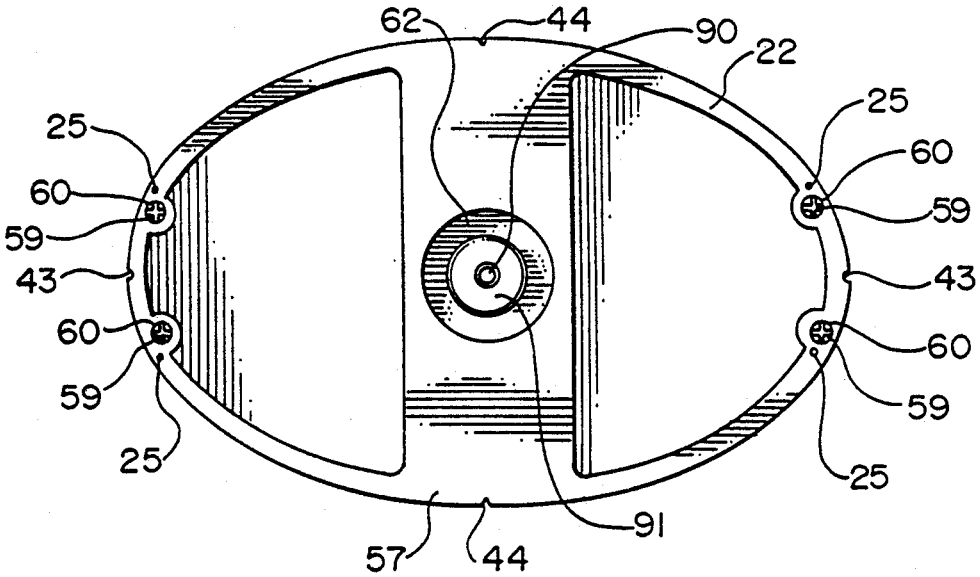
FIG. 10 provides a bottom plan view along the line 10—10 of the mat cutter of FIG. 9.

The components of the oval cutter 21 appear in FIG. 7. The base 22 of the prior figures includes the base bottom 57 and the base top 58 held together by the bolts 59 which pass through the openings 60 in the base bottom and attach to the base top. FIGS. 8 through 10 give different views of the base 22 after its assembly. As seen in FIG. 7, the base bottom 57 includes the groove 61 running transversely through it. This groove has a width and depth sufficient to accommodate the sliding block 62. In other words, the block 62 fits within the groove 61 and may slide from side to side within it. In fact, the center of the block 62 thus moves in a straight line along the shorten axis of the desired oval as established by the markers 44 sitting on the line 42 in FIG. 4.

The base bottom 57 also includes the shoulders 65 at either of its narrow ends which establish the valley 66 between them. The valley 66 should have sufficient depth and width between the shoulders 65 to accommodate the radial plate 37. The depth of the valley 66 between the shoulders 65, however, does not accommodate the ridge 69 on the radial plate 37. This must sit within the elongated central groove 70 which passes all of the way through the base top 58. Thus, the base top 58 adheres to the base bottom 57 with the radial plate 37 sitting between them as seen in FIGS. 8 and 9 and the ridge 69 extending into the groove 70 in the base top 58. When creating an oval, the placement of the arrows 73 on the adjustment plate 36 along the scales 39 on the radial plate 37 determines the difference in sizes between the lengths of the major and minor axes of the resulting oval.

The construction of the base 22 with its associated parts for cutting an oval involve attaching the base top 58 to the base bottom 57 by the bolts 59 with the radial plate 37 sandwiched between. The post 78 passes through the groove 70 of the (now attached) base top 58. Specifically the groove 79 in the post 78 fits over the ridge 69 in the radial plate 37. The bolt 82 then passes through the opening 83 through the radial plate 37 and, in particular, the ridge 69 and fits tightly into the opening 84 of the bottom of the post 78. The bolt 82 attaches the post 78 tightly to the radial plate 37 with the ridge 69 fitting tightly into the groove 79 of the post 78. The tight fit of the ridge 69 in the groove 79 of the post 78 maintains the relative radial orientation of the post 78 compared to the radial plate 37. In other words, when the post 78 moves, as discussed below, so must the radial plate 37 since the groove 79 bears upon the ridge 69. Thus, the one can not rotate or, in fact, move in any direction without the other accompanying it.

Furthermore, the bolt 38 passes through the opening 87 in the adjustment plate 36, the opening 88 between the scales 39 of the radial plate 37, the opening 89 of the sliding block 62 and tightly into the opening 90 of the adjustment nut 91. This attachment may proceed by placing the sliding block 62 into the groove 61 of the base bottom 57 and sliding it so that its opening 89 aligns with the opening 93 in the base bottom 57. The operator then places the adjustment nut 91 through the opening 93 and into a groove in the bottom of the sliding block 62 which surrounds the opening 89 as seen in FIG. 7A. He then places the adjustment plate 36 on top of the scale 39 and secures the bolt 38 to the adjustment nut 91. When secured in this fashion, the adjustment nut 91 fits into the groove in the bottom of the sliding block 62 so that the latter may smoothly move within the groove 61 of the base bottom 57.

The adjustment plate 36, on its bottom, includes the ridge 97 which fits into the opening 88 of the radial plate 37. With the arrows 73 pointing toward the ridge 69, the front edge 98 points to the distance on the scale 39 by which the larger axis of the resulting oval will exceed the length of the smaller axis, or, in other words, the oval's eccentricity.

At the upper end of the post 79, the arm 23 sits within the groove 104 where the bolt 105 holds it in place. The tight fit of the arm 23 in the groove 104 of the post 78 assures that the arm 23 and the post 78 maintain the same radial orientation relative to each other. In other words, rotating one requires that the other must likewise turn.

The oval scale 33 fits into the groove 107 of the arm 23 and also covers the bolt 105. As shown in FIG. 2, the arrow 31 on the block 29 points to the marking 32 on the scale 33 to indicate the overall size of the oval that the cutter 21 will produce.

The arrangement just described with regards to FIG. 7 results in the production of an oval which has a difference between the lengths of the major and minor axes as determined by the location of the adjustment plate 36 along the scale 39 of the radial plate 37. Initially, the post 78 remains constrained to move in the groove 70 of the base top 58. The sliding block 62 must remain in the groove 61 in the base bottom 57. Accordingly, the sliding block 62 moves linearly in the groove 61 while the post 78 moves linearly in the groove 70 but perpendicular to the direction that the sliding block 62 moves.

As a result of the orientation of the ridge 69 in the radial plate 37 and the grooves 84 and 104 in the post 78, the oval arm 23 lies parallel to the groove 88 in the scale 39 in the radial plate 37. However, the center of the post 78 remains separated from the center of the sliding block 62 by the amount set by the adjustment plate 36 on the scales 39 of the radial plate 37. In other words, the center of the post 78 and the center of the sliding block 62 can not sit over each other; they remain separated laterally by the setting of the adjustment plate 36 on the scales 39.

Thus, when the arm 23 lies parallel to the elongated groove 70 in the base top 58, the groove 88 in the radial plate 37 does so also. In this orientation, the sliding block 62 must lie exactly in the middle of the groove 61, or over the opening 93. This forces the post 78 away from the middle of the elongated groove 70 by the amount that the post 78 is separated from the sliding block 62.

When the arm 23 rotates 90 degrees so that it lies perpendicular to the elongated groove 70, the groove 88 in the radial plate 37 also lies perpendicular to the elongated groove 70 and thus parallel to the groove 61 in the plate bottom 57. This forces the sliding block 62 off to the side in the groove 61 and thus the post 78 sits directly at the middle of the elongated groove 70. Accordingly, as the arm 23 moves from the position where it lies parallel to the elongated groove 70 to where it falls perpendicular, the post 78 moves from a position where it lies away from the center of the groove 70 to where it actually occupies the center of that groove. Thus, instead of a particular position on the arm 23 describing a circle, it must describe an oval because, as it acquires angular motion, it also moves inward toward the center of the base 22. As the arm 23 continues to move from a position perpendicular to the elongated groove 70 through another 90 degrees where it again lies parallel to the groove 70, the radial plate 37 also describes the same rotation. When the groove 88 again lies parallel to the groove 70, the sliding block 62 again occupies a position at the middle of the groove 61 and thus over the opening 93. This thrusts the post 78 again toward the end of the elongated groove (by an amount determined by the position of the adjustment plate 36 on the scales 39). Thus, during the second 90-degree rotation, the arm 23 not only achieves angular motion, but must also move further out away from the center of the base 22 as the post 78 moves toward the end of the elongated groove. This has accomplished half of the desired oval. The other 180 degrees of motion, by an analysis according to the above, creates the second half of the oval.

Figure 11:
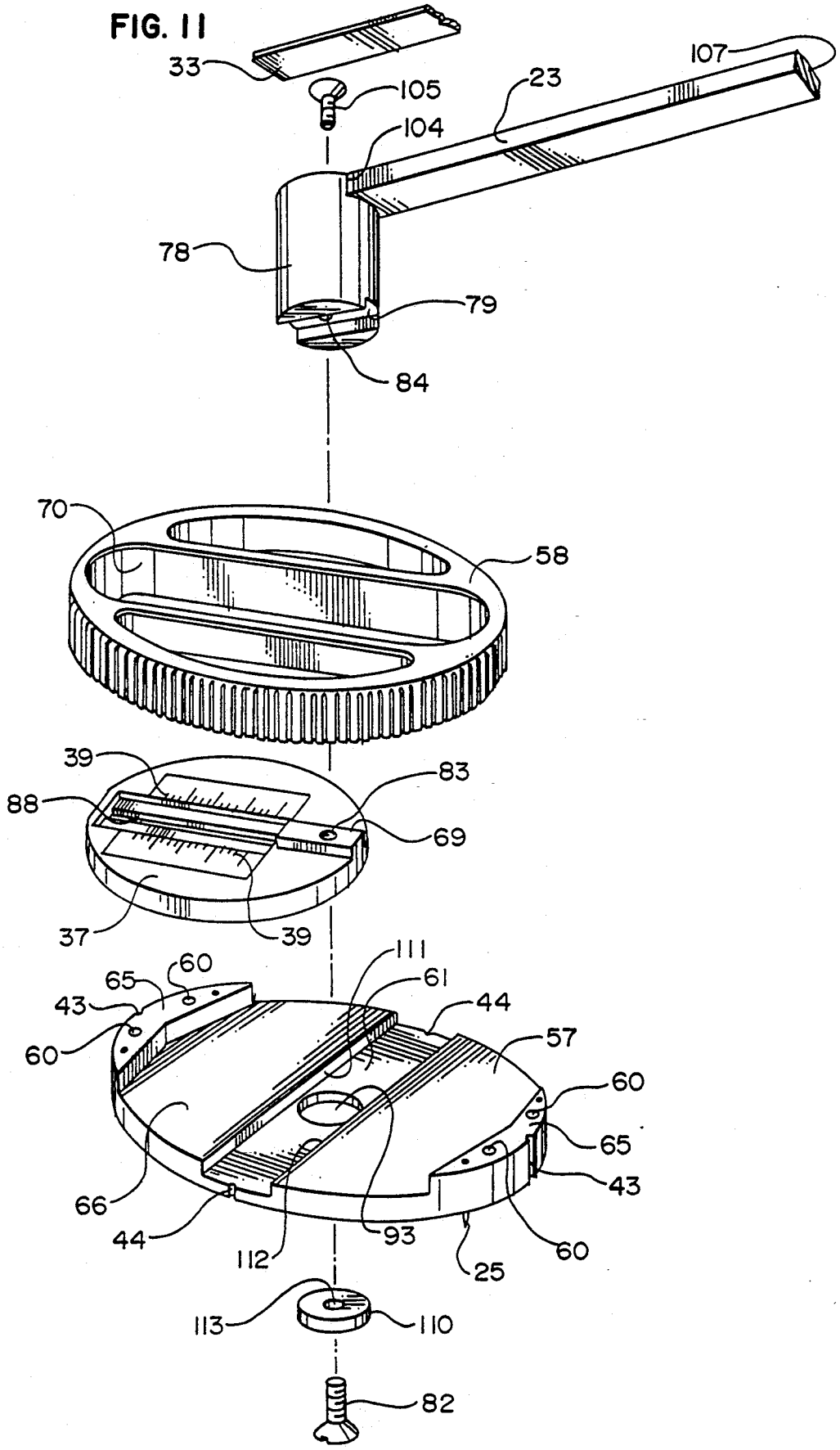
FIG. 11 depicts an exploded view of the components of the mat cutter of the prior figures but using the components in the arrangement required to cut circles.

At times, the view that will appear through a mat will appear best where the opening takes the shape of a circle. Achieving this configuration merely requires placing the circle button 110 on the bottom of the radial plate 37 and attaching it to the plate 37 and the plate 37 to the bottom of the post 78 through the bolt 82 as seen in FIG. 11. When thus installed, the button 110 abuts against the edges 111 and 112 of the groove 61. This prevents the lateral motion of the post 78 within the elongated groove 70. This is simply because the button 110 cannot move laterally between the sides 111 and 112 of the groove 61. As a consequence, the post 78 must remain exactly within the center of the elongated groove 70 even as it rotates. Thus, any point on the arm 23 must describe a circle as it rotates about the base 22. During this time the ridge 69 on the radial plate 37 also describes a circle. The remainder of the plate 37 moves around between the base top 58 and the base bottom 57. However, that does not affect the circle created by the movement of the arm 23 about the center of the base. Thus, to convert between the mechanism creating an oval and that to describing a circle simply requires, in FIG. 7, the removal of the bolt 38, the adjustment plate 36, the sliding block 62, and the adjustment nut 91. The post 78 should then be moved over to the center of the elongated opening 70 in the base top 58 which results in the bolt 82 appearing in the center of the opening 98 in the base bottom 57. This permits the removal of the bolt 82 from the bottom of the plate 37, the insertion of the button 110 through the opening 93 in the base bottom 57, and the reattachment of the bolt 82 through the opening 113 in the button 110, the opening 83 in the plate 37, and tightly into the opening 84 of the post 78 to complete the construction in FIG. 11. Returning the cutter to the form in which it can create ovals as seen in FIG. 7 simply involves a reversal of that process.

The cutter mechanism 24, in FIG. 7, includes first, the channel block 29 with the groove 115 passing through it. This allows the block 29 to fit onto the arm 23. The lock nut 30, when tightened, keeps the block 29 at the desired location on the arm 23. The channel block shaft 116 has a press fit into the opening 117 in the bottom of the channel block 29. The shaft 116 has the groove 118 cut into its bottom.

In turn, the bearing 121 has a press fit into the opening 123 of the swivel foot 125. The shaft 116 then fits into the opening 126 of the bearing 121. The set screw 127 passes into the opening 128 of the swivel foot 125, the opening 129 of the bearing 121, and then the groove 118 of the shaft 116. In this position, its serves to keep the shaft 116 in the bearing 121, and thus the channel block 29 attached to the swivel foot 125. Yet, it allows the swivel foot 125 to rotate about the shaft 116 and thus the channel block 29. The post 133, press fit into the bottom of the channel block 29 will, upon the rotation of the swivel foot 125, abut against the shoulder 134. The relative location of the post 133 to the shoulder 134 appears more clearly in FIGS. 12 and 13. The post 133 serves to limit excessive rotation of the swivel foot and to assure that the knife 47, with the arm 23 moving in the clockwise direction, properly contacts the mat that it will cut.

The cover plate 141 serves to keep the knife 47 attached to the swivel foot 125. Specifically, the screw 142 passes through the opening 143 of the cover plate and then into the opening 145 of the swivel foot 125. It permanently retains the cover plate 141 to the swivel foot 125. The knob bolt 146 passes through the opening 147 of the cover plate 141 and then into the swivel foot 125. The knob bolt 146 permits its facile removal to allow for the insertion and removal of the knife 47 from the groove 148 in the cover plate 141. Lastly, the set pin 149 passes through the opening 150 of the cover plate 141 and then into the swivel foot 125. It abuts against the edge 152 of the knife blade 47 when the latter has slid down the groove 148 to its proper operating position. In other words, it prevents the knife blade 47 from extending further from the swivel foot 125 then it should in order to make the appropriate cuts into the mat as previously discussed.

The lever pivot pin 154 passes loosely through the opening 155 in the stepping lever 54 and then has a press fit into the opening 156 of the swivel foot 125. It serves to attach the stepping lever 54 to the swivel foot 125 but allows the former to rotate relative to the swivel foot 125. In a similar fashion, the roller pivot pin 158 passes loosely through the opening 159 in the roller wheel 48 and then has a press fit into the opening 160 of the stepping lever 54. Again, the loose fit of the roller wheel 48 about the roller pin 158 allows the wheel 48 to rotate freely. In actual use, when the roller wheel contacts the mat, it moves and its sharp edges 53 will actually make a track or groove into the top of the mat as discussed above.

With the stepping lever 54 attached to the swivel foot 125, the pressure pin 161 enters the opening 162 of the swivel foot 125. The spring 163 forces it out of the opening 162 and against the top edge 164 of the stepping lever 54. The set screw 165 fits into the top of the opening 162 to keep the pressure pin 161 and the spring 163 inside the swivel foot 125 and pressing against the stepping lever 54 as seen in FIGS. 15 to 18.

To allow the roller wheel 48 to make the initial groove or track into the mat, the stepping lever 54 occupies its most counterclockwise position as seen in FIG. 15. In this configuration, the pin 161 enters the indentation 167 in the top 164 of the lever 54. This results in the outer circumference of the wheel 48 extending beyond the tip of the knife blade 47, as seen in FIG. 15, to make the initial track in the top of the mat.

After the wheel 48 has made a track in the mat, the operator moves the stepping lever 54 one step in the clockwise direction until it achieves the configuration seen in FIG. 16. There, the pin 161 enters the indentation 168 in the top 164 of the lever 54 seen in FIG. 19. This results in the slight extension of the tip of the knife blade 47 beyond the roller wheel 48 so that it can made its initial, shallow cut into the top of the mat. After it has done so completely, the operator moves the stepping lever 54 an additional notch to the right to achieve the configuration seen in FIG. 17. There, the pin 161 enters the indentation 169 in the lever 54, again as seen in FIG. 19. This projects the knife 47 further beyond the exterior circumference of the roller wheel 48 to make a medium depth cut into the mat. Finally, the operator moves the stepping lever 54 as far as it will go in the clockwise direction as seen in FIG. 18. There, the pin 161 simply rides on the surface 170. To determine the proper configuration so that the knife blade 47 will extend appropriately beyond the roller wheel 48, the set screw 171 extends an appropriate distance from the swivel foot 125 so that the lever arm 54 abutting against it establishes the proper position of the roller wheel to allow the knife blade 47 to make the final complete cut through the mat. This will complete the cutting of the oval or the circle in the mat.

Other arrangements than that shown in the figures can also serve to produce ovals. For example, as seen in FIG. 3 and indicated in FIG. 8, the radial arm 23 extends from the post 78 in the opposite direction as the adjusting plate 36 and the radial plate 37. This does not constitute an absolute requirement. The arm 23 extending from the post 78 could actually form any angle relative to the line connecting the post 78 to the adjusting plate 36. This would have the effect of actually rotating the resulting oval by a number of degrees equal to half of that by which the angle between the radial arm 23 and the line separating the post 78 and the adjusting plate 36 falls less than 180 degrees. While this would work to make ovals, it would make the prediction of the exact location of the oval more difficult. Furthermore, FIG. 7 shows the groove 61 in the base bottom 57 lying perpendicular to that of the elongated groove 70 in the base top 58. This need not occur either nor need these grooves actually constitute straight lines for the movement of the sliding block 62 or the post 78, respectively. Yet, the illustrated construction simplifies the prediction of the orientation and size of the resulting oval.

Accordingly,

What is claimed is:

1. In a mat cutter for cutting an oval including:

(1) a base capable of being placed on a mat;

(2) incising means for making a cut into a mat at a first particular location; and (3) with said base on said mat, guide means, coupled to said base and to said incising means, for controlling the motion of said incising means about a second location located at said base, the improvement wherein said guide means comprises:

(A) first extension means, coupled to said incising means, for rigidly separating said incising means from a first point removed from said incising means, said first extension means including a section of rigid material surrounding said first point;

(B) with said base on said mat, first restraining means, coupled to said first extension means and to said base and located within said base, for limiting the locus of said first point to a first line passing through said second location, said first restraining means including (1) a plateform formed in said base and having a groove therein and (2) restricting means, coupled to said base, for restricting the motion of said section of rigid material to said groove;

(C) with said base on said mat, second extension means, coupled to said incising means, said first point, and said base and located within said base, for rigidly separating both said incising means and said first point from a second point removed from said incising means, said base being adapted to be placed on said mat at said second location;

(D) adjusting means, coupled to said second extension means, said first and second points, and said base and located within said base, for adjusting the distance between said first and second points continuously over a predetermined range; and (E) with said base on said mat, second restraining means, coupled to said second extension means and said base and located within said base, for limiting the locus of said second point to a second line passing through said second location at a nonzero angle to said first line.

2. The improvement of claim 1 wherein said section of rigid material is a first section of rigid material, said groove is a first groove, said restricting means is a first restricting means, and said second extension means includes a second section of rigid material around said second point, said second restraining means includes (1) a second groove in said base and (2) second restricting means, coupled to said base, for restricting the motion of said second section of rigid material to said second groove.

3. The improvement of claim 2 wherein said incising means includes a knife for making a cut in a mat and limiting means, coupled to said knife, for limiting the movement of said knife to the immediate vicinity of a predetermined line and further comprising:

(A) depth control means, coupled to said knife and having a plurality of configurations, for limiting the depth of said knife below the surface of said mat, said control means, in at least two of said configurations, limiting said knife to different depths; and (B) selector means, coupled to said control means, for manually changing said depth control means between said configurations.

4. The improvement of claim 3 wherein said control means includes a wheel, coupled to said knife, said control means placing said knife, in said configurations, at different extensions beyond the outer circumference of said wheel.

5. The improvement of claim 4 wherein said control means includes at least four configurations and, in all of said four configurations, places said knife at different extensions relative to the outer circumference of said wheel.

6. The improvement of claim 5 wherein, in at least one of said configurations, said control means retains all of said knife above the surface of said mat.

7. The improvement of claim 6 wherein the outer circumference of said wheel includes a sharp ridge capable of making a groove in said mat.

8. The improvement of claim 2 wherein said first and second lines are substantially straight.

9. The improvement of claim 3 wherein said first and second lines are substantially perpendicular to each other.

10. The improvement of claim 3 wherein said adjusting means is a first adjusting means and further including second adjusting means, coupled to said first extension means, for changing continuously the distance by which said first extension means separates said incising means from said first point.

11. The improvement of claim 10 wherein said second extension means separates said first and second points from each other by a zero distance.

12. The improvement of claim 10 wherein said second extension means separates said first and second points from each other by a nonzero distance.

13. The improvement of claim 12 wherein the first line along which said first extension means separates said incising means from said first point and the second line along which said second extension means separates said first and second points are parallel to each other.

14. The improvement of claim 13 wherein said first line lies on the opposite side of said first point from said second line.

15. The improvement of claim 12 wherein said incising means includes a knife for making a cut in a mat and limiting means, coupled to said knife, for limiting the movement of said knife to the immediate vicinity of a predetermined line and further comprising:

(A) depth control means, coupled to said knife and having a plurality of configurations, for limiting the depth of said knife below the surface of said mat, said control means, in at least two of said configurations, limiting said knife to different depths; and (B) selector means, coupled to said control means, for manually changing said depth control means between said configurations.

16. The improvement of claim 15 wherein said control means includes a wheel, coupled to said knife, said control means placing said knife, in said configurations, at different extensions between the outer circumference of said wheel.

17. The improvement of claim 16 wherein said control means includes at least four configurations and, in all of said four configurations, places said knife at different extensions relative to the outer circumference of said wheel.

18. The improvement of claim 17 wherein, in at least one of said configurations, said control means retains all of said knife above the surface of said mat.

19. The improvement of claim 18 wherein the outer circumference of said wheel includes a sharp ridge capable of making a groove in said mat.

* * * * *